US007370448B2

(12) United States Patent
Burrous et al.

(10) Patent No.: US 7,370,448 B2
(45) **Date of Patent: *May 13, 2008**

(54) SNAP FRAME DISPLAY ASSEMBLY

(75) Inventors: Thomas P. Burrous, Haverhill, MA (US); David E. Pitcher, Cambridge, MA (US)

(73) Assignee: Rose Displays Ltd., Salem, MA (US)

( * ) Notice: Subject to any disclaimer, the term of this patent is extended or adjusted under 35 U.S.C. 154(b) by 398 days.

This patent is subject to a terminal disclaimer.

(21) Appl. No.: 11/223,749

(22) Filed: Sep. 9, 2005

(65) Prior Publication Data

US 2006/0005442 A1 Jan. 12, 2006

Related U.S. Application Data

(63) Continuation-in-part of application No. 10/848,651, filed on May 19, 2004, now Pat. No. 7,076,899, which is a continuation-in-part of application No. 10/440,923, filed on May 19, 2003, now Pat. No. 6,880,280, which is a continuation-in-part of application No. 09/820,069, filed on Mar. 28, 2001, now Pat. No. 6,678,982.

(51) Int. Cl.

| | |
|---|---|
| ***G09F 7/02*** | (2006.01) |
| ***G09F 7/06*** | (2006.01) |
| ***A47G 1/06*** | (2006.01) |

(52) U.S. Cl. ..... 40/611.02; 40/611.12; 40/793; 40/791; 40/790

(58) Field of Classification Search ..... 40/611.01, 40/611.02, 611.11, 611.12, 781, 790, 791, 40/792, 793, 796; 160/327, 380, 371–381; 38/102.2, 102.91

See application file for complete search history.

(56) References Cited

U.S. PATENT DOCUMENTS

| | | | | |
|---|---|---|---|---|
| 3,310,901 | A * | 3/1967 | Sarkisian | 40/793 |
| 4,519,152 | A * | 5/1985 | Seely et al. | 40/791 |
| 4,523,400 | A * | 6/1985 | Seely | 40/791 |
| 4,835,891 | A * | 6/1989 | Joffe | 40/647 |
| 5,815,971 | A * | 10/1998 | Rothe et al. | 40/718 |
| 6,553,705 | B2 * | 4/2003 | Geiberger et al. | 40/793 |
| 6,678,982 | B2 * | 1/2004 | Pitcher et al. | 40/793 |
| 6,880,280 | B2 * | 4/2005 | Burrous et al. | 40/793 |
| 7,076,899 | B2 * | 7/2006 | Pitcher et al. | 40/611.02 |

* cited by examiner

*Primary Examiner*—Lesley D. Morris
*Assistant Examiner*—Christopher E Veraa
(74) *Attorney, Agent, or Firm*—Don Halgren

(57) ABSTRACT

A snap frame assembly for engagably supporting a one or double sided planar display panel, comprising an elongated extruded carrier frame having an elongated housing with a central opening therein, an elongated extruded front plate slidably mounted on an elongated rigid member extending from the housing, and an elongated pivotable member flexibly attached to the housing by an elongated commonly extruded hinge. The front plate has an upper channel member which rotatively pivots on an arm extending from the housing and has a lower channel member which pivots together with a curved housing plate which comprises a portion of the housing of the carrier frame.

18 Claims, 4 Drawing Sheets

SNAP FRAME DISPLAY ASSEMBLY

This invention comprises a continuation-in-part application of U.S. patent application Ser. No. 10/848,651 filed on May 19, 2004 now U.S. Pat. No. 7,076,899, which is a continuation-in-part of U.S. patent application Ser. No. 10/440,923, filed May 19, 2003 now U.S. Pat. No. 6,880,280 which is a continuation-in-part application of commonly assigned U.S. patent application Ser. No. 09/820,069, filed Mar. 28, 2001, 20 now U.S. Pat. No. 6,678,982 issued 20 Jan. 2004 each of which are incorporated by reference herein, in its entirety.

BACKGROUND OF THE INVENTION

1. Field of the Invention

This invention relates to extruded component assembly for biasably holding a panel display such as a poster gripping assembly against a wall or from an overhead suspension arrangement.

2. Prior Art

Poster gripping assemblies have been known in the field, for a number of years. One such instance is shown in U.S. Pat. No. 4,519,152 to Seely et. al. which shows a tamper proof poster display arrangement. This display arrangement has an outer cover portion with certain defined angles which make it difficult to open the cover from its base. An "opener tool" is required for that. The cover and the base portions are independently extruded and have a hinge relationship which requires a difficult "slide together" assembly. U.S. Pat. No. 4,937,959 to Palmer et. al. discloses a gripper extrusion arrangement wherein a front cover portion and a rear panel portion are separately extruded and mated together in another complicated hinge assembly. Inadvertent sliding between the front cover portion and the rear panel portion is prevented by a rather complicated discontinuity formed in the front panel which mates with a slot or the like in the rear panel. This requires further operations and unnecessary manufacturing costs. U.S. Pat. No. 5,307,575 to Ivansson et. al. shows a frame corner assembly wherein adjacent sides of a frame are held together with a rather complicated bracket arrangement. The cover portions and rear panel portions are individually extruded and are snapped together. Alignment of the ends of these multiple component arrangements lead to inaccurate end mis-aligned corner sections. U.S. Pat. No. 5,732,496 to Tanaka shows a sign frame with corner arrangements for attaching sides of that frame together. Mitered alignment of the corners is avoided by a corner insert which is somewhat more expensive to manufacture and adds a further step in that procedure.

It is an object of the present invention, to provide a frame display poster gripping assembly which overcomes the disadvantages of the prior art.

It is a further object of the present invention to provide a poster gripping assembly which may be utilized in a poster-holding configuration by itself or in a frame construction of rectilinear configuration for one or two sided displays.

It is a further object of the present invention to provide a poster gripping assembly which simplifies the manufacturing operation over the prior art.

It is another object of the present invention to provide a poster gripping apparatus with a unique multi-curved biasing arrangement which may be readily assembled and/or re-configured with a front plate to permit adjustment of its bias.

It is yet still a further object of the present invention to provide a poster gripping assembly which may be assembled into a rectilinear frame construction with accuracy and simplicity while minimizing the likelihood of defects as may be associated with the prior art.

BRIEF SUMMARY OF THE INVENTION

The present invention comprises a poster/display gripping assembly of elongated extruded components for gripping planar objects. One such primary component of this gripping assembly is an elongated, arcuate front plate having a front or forward side and a rearward or backside. The other primary component of this gripping assembly comprises an elongated carrier frame on which the front plate is mounted.

One such embodiment of this gripping assembly includes a front plate component with a curved upper edge and an angled lower edge extend rearwardly from the front plate. The curved upper edge has a "J"-shaped flange which defines a first upper channel therewithin. The J-shaped edge has an elongated lip extending parallel, along an inner side thereof. An elongated guide flange is arranged parallel to the elongated lip on the inner side of the curved upper edge of the elongated front plate. An elongated L-shaped finger extends off the rear side of the elongated front plate, adjacent the lower edge thereof. The elongated L-shaped finger is spaced apart from the lower curved wall on the rear side of the elongated front plate extending from the lower edge thereof. The elongated L-shaped finger and the lower curved wall define a foot-engaging lower channel between them.

A further embodiment of the front plate component of the assembly comprises an elongated flat front plate with a front side and a rear or back side, and also having an upper edge and a lower edge. The upper edge of the elongated flat front plate has an elongated wall member extending rearwardly therefrom. The wall member is arranged perpendicularly to the elongated flat front plate. The elongated wall member has a distal edge defined by an elongated J-shaped flange which defines an elongated upper channel therewithin. An elongated lip extends parallel to the upper channel on an inner side portion of the wall member. An elongated guide wall extends on an inner side of the wall member in parallel relationship and spaced apart from the elongated lip adjacent the J-shaped edge. An elongated L-shaped finger extends from the inner side of the elongated flap front plate adjacent a lower edge thereof. An elongated lower J-shaped curved wall extends along a lower most portion of the inner edge of the elongated flat front plate and is spaced apart from the elongated L-shaped finger. A foot-engaging lower channel is defined by the space between the elongated L-shaped finger and the elongated J-shaped curved wall adjacent the lower edge of the elongated flat front plate. An elongated bulbous edge is arranged on the lowermost portion of the elongated flat front plate in this embodiment.

A first embodiment of the elongated carrier frame or internal gripping component of the compound assembly of the present invention is comprised of an elongated slightly curved backing plate having an upper edge and a lower edge. An elongated bridging portion extends along a forward side of the elongated upper edge of the elongated backing plate. The elongated bridging portion has an elongated forward edge which comprises a portion of a front housing. The front housing has a lower portion defined by a J-shaped lower wall. An elongated lip extends along the inner side of the elongated bridge portion to define an elongated T-shaped volume between the elongated lip and the J-shaped lower edge of the front housing. An elongated support tab extends forwardly from the front face of the front housing. An elongated arm extends angularly upwardly from the upper side of the elongated tab, to support a commonly extruded rearwardly extending J-shaped branch at a distal end, thereof. The elongated tab extending from a mid portion of the front housing has a forward edge which defines a commonly extruded, elongated living hinge. The living hinge is co-extruded with a double curved (somewhat sinusoidal) housing plate of somewhat S-shaped in cross-sectional configuration. The upper edge of the curved housing plate is co-extruded with the living hinge and attached thereto to the elongated tab and front housing. The double curved housing plate has a lower edge with an elongated gripper pad extending off of a lower portion facing rearwardly thereon. The double curved housing plate has a lower edge with an elongated extending leg thereat. The extended leg has an elongated curved connection thereon which is connected to an elongated planar securement foot thereat. The elongated double curved housing plate is arranged to be pivotable about the elongated living hinge between the hinge and the upper edge of the double curved housing plate.

A further embodiment of the elongated carrier frame portion of the present invention comprises a generally elongated, rectangularly shaped, hollow, extruded housing having a backside onto which an adhesive layer of material is attached. The elongated housing has a front side with an elongated tab extending therefrom. The elongated tab has an upper portion on which an elongated arm is angularly arranged. The elongated angular arm has an upper edge with a rearwardly directed J-shaped elongated carrier branch extending thereon. The elongated tab has a forwardly directed distalmost edge having an elongated living hinge commonly extruded therewith. A double curved housing plate of generally S-shaped in cross section, has an upper end which is co-extruded with the living hinge attached to the elongated tab. The double curved housing plate has a lower edge on which an elongated gripper pad is arranged on a rearward side thereof. An elongated leg extends forwardly from the elongated lower edge of the double curved housing plate and has an elongated curved connector extending between the extending leg and an elongated, planar securement foot arranged thereon in a manner similar to the aforementioned embodiment.

A further embodiment of the generally carrier frame of the present invention comprises a central, generally H-shaped double channel housing arranged to support a first and a second double curved housing plate for grasping and displaying two sided panels, if desired. The double channel housing comprises a first and a second generally rectangularly shaped extrusion each having a closed, spaced-apart flange between which is defined the elongated double channel. The first (outer) side of each side of the double channel housing has an elongated tab extending therefrom. An elongated arm extends upwardly from the elongated tab on the first side on each side of the double sided housing and an elongated branch extends with a J-shaped rearwardly extending rearwardly with respect to the first and second housing portions thereof. The elongated tab, as with the other aforementioned embodiments, has an elongated living hinge distally running therealong, which living hinge is attached to the upper edge of a double curved housing plate. The first and second double curved housing plates each have an elongated lower edge with an elongated gripper pad arranged thereon. An extended leg is arranged from the respective forward sides of the lower edge of the elongated first and second double curved housing plate. A curved connector is arranged at the forward edge of each of the respective elongated legs and secures an elongated planar securement foot thereon. The elongated carrier frame of the present embodiment with its second double curved housing plate on the opposite side thereof, comprises a mirror image of the first double curved housing plate with its appropriately correspondingly directed elongated arm and elongated tab with its respective living hinge arranged therewith.

One snap frame display assembly contemplated by the present invention comprises the elongated backing plate and associated elongated front housing with its double curved housing plate therewith, slidingly mated with the elongated flat front plate so as to provide an articulable biasable combination for holding a planar sheet between the elongated gripper pad at the lower edge of the double curved housing plate and a lower edge of the backing plate. The elongated edge of the J-shaped branch extending from the elongated arm is slidably mated within the first upper channel of the elongated flat front plate. That upper channel is found within the J-shaped edge on the wall member extending rearwardly from that elongated flat front plate. The elongated planar securement foot extending from the extended leg of the lower edge of the double curved housing plate is arranged to pivotably mate within the lower channel of the elongated flat front plate, that lower channel defined by the elongated L-shaped finger and the elongated lower curved wall arranged on the inner side of rear side of that flat front plate. Such assembly of the components is accomplished by sliding respective smaller J-shaped components of the carrier frame into the elongated openings created by the larger J-shaped channels of the housing plate.

A further combination assembly combination of the present invention is contemplated with the generally retangularly shaped elongated housing having its front side thereof being slidably mated with the elongated double curved front housing plate arrangement identified hereinabove. The elongated upper channel defined by the J-shaped edge at the rearward side of the elongated curved upper edge of the elongated curved front housing plate slidably receives the elongated J-shaped distal portion of the elongated carrier frame front branch disposed on the elongated arm on the upper side of the tab on the front side of the rectangular housing. The elongated planar securement foot extending from front side of the extended leg on the lower edge of the double curved housing plate slidably mates with the lower channel at the rearward side of the elongated curved front plate which lower channel is defined by the elongated L-shaped finger and the elongated lower J-shaped curved wall at the rearward side along the lower edge thereof.

A further embodiment of the snap frame assembly invention includes the elongated carrier frame of the present invention is contemplated by the aforementioned use of the elongated retangularly-shaped, adhesively backed housing slidably engaged with the elongated flat front plate wherein the elongated carrier frame front branch and its distalmost J-shaped elongated portion slidably mates with the upper channel within the J-shaped edge of the wall member of the elongated flat front plate. The elongated planar securement foot arranged on the distal edge of the extended leg on the elongated lower edge of the double curved housing plate is arranged so as to provide a rearwardly biasable action to the elongated gripping pad arranged on the lower edge of the elongated double curved housing plate.

A further embodiment of the snap frame assembly construction of the present invention comprises the elongated carrier frame of generally double channel housing of H-shape in cross section, having a first double curved housing plate and a second double curve housing plate extending off in mirror image fashion from each outer side face of the double channel housing, each double curve housing plate slidably engaged with elongated curved front plates slidably received within their uppermost channels by the J-shaped distalmost portions on the elongated arms extending from the elongated tabs extending from mid-portions of the housings with the respective elongated planar securement feet arranged within the lower channels of each respective double curved housing plate and their respective elongated L-shaped fingers and elongated lower curved walls adjacent the inner directed sides along the lower edge thereof for pinching one or two sided display panels therebetween.

A still further embodiment of the snap frame assembly of the present invention contemplates the elongated carrier frame as aforementioned here in the slidable combination with the generally H-shaped double channel housing having a mirror image of respective first and second double curved housing plates extending oppositely therefrom in sliding engagement with the elongated flat front plates therewith. The J-shaped distalmost portions of the elongated arms extending from the elongated tabs on the outwardly directed sides of each first and second housing portions engaging the upper channels of each respective elongated flat front plates in a mirror image of one another, where respective elongated planar securement feet are arranged within the lower channels of those elongated flat front plates to provide a pitching from opposite sides thereof of any planar member supported between the opposed elongated gripping pads on the lowermost edge of the respective double curved housing plates.

The frame assemblies of the aforementioned embodiments are all mateable with joinery components of corner assemblies. Those corner assemblies may be comprised of a corner angle with a generally square shaped corner upper cover, and a generally square shaped lower corner backing. Each corner cover and backing is spaced on the upper and lower sides of the corner angle. The extended portions of the corner angle mate with the respective central openings defined by the housings of the elongated carrier frames so as to permit the assembly of a rectangular housing display.

Thus there has been shown a unique combination of components for assembly a rectilinear housing for displaying a planar panel either against a wall for one sided viewing thereof, or supported from an overhead support system thus permitting two sided planar display arrangements. Such display arrangements are readily changeable and adaptable as such display arrangements require by the pivotable lifting of the lower edges of either the elongated flat front plate or the lowermost edge of the elongated curved front plate which permits the biasing and un-biasing of the articulable double curved housing plates against such a display.

The invention thus comprises a snap frame assembly for engagably supporting a planar display panel, comprising an elongated extruded carrier frame having an elongated housing with a central opening therein, an elongated extruded front plate slidably mounted on an elongated rigid member extending from the housing and an elongated pivotable member flexibly attached to the housing by an elongated commonly extruded hinge. The front plate has an upper channel member which rotatively pivots on an arm extending from the housing and a lower channel member which pivots together with a curved housing plate which comprises a portion of the housing of the carrier frame. The elongated housing of the carrier frame may have a pair of central openings. The central openings are arranged to receive a corner angle to support a pair of assembled carrier frames and a pair of front plates. The curved housing plate preferably has a sinusoidal configuration thereto. The housing plate is connected to said housing by a living hinge therebetween. The curved housing plate has a lower edge with a planar foot thereon, that planar foot being pivotable in the lower channel of the cover plate. The housing may have an elongated strip of adhesive on a back portion thereof to permit the assembly to be attached to a wall surface. The housing may have a pair of spaced apart flanges which define an elongated opening for an overhead support to enter. The front plate has a lowermost edge which is spaced apart from the planar display panel to permit manual pivotable moving of the front plate away from the play panel. The housing may include a pair of curved housing plates pivotably supported thereon. The curved housing plates may be pivotable independent of one another.

The invention also comprises a snap frame assembly for engagably supporting a planar display panel, comprising an elongated extruded carrier frame having an elongated housing arrangement with a pair of elongated central openings therein, a pair of elongated extruded front plates each slidably mounted on a respective elongated rigid member extending respectively from the housing arrangement and an elongated pivotable member flexibly attached to each respective housing by an elongated commonly extruded hinge, wherein the front plates each have an upper channel member which rotatively pivots on a respective arm extending from the housing and each have a lower channel member which pivots together with a respective curved housing plate which comprises a portion of said respective housing of said carrier frame. The planar display panel may be a two sided display.

BRIEF DESCRIPTION OF THE DRAWINGS

The objects and advantages of the present invention will become more apparent, when view in conjunction with the following drawings in which.

DETAILED DESCRIPTION OF THE PREFERRED EMBODIMENTS

Figure 5:
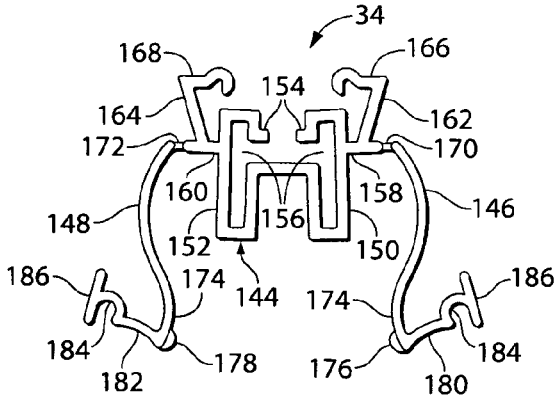
FIG. 5 is an end view of an elongated carrier frame having a first and a second double curved housing plate in a mirror like orientation supported on a double channeled housing of generally H-shape.
Figure 6:
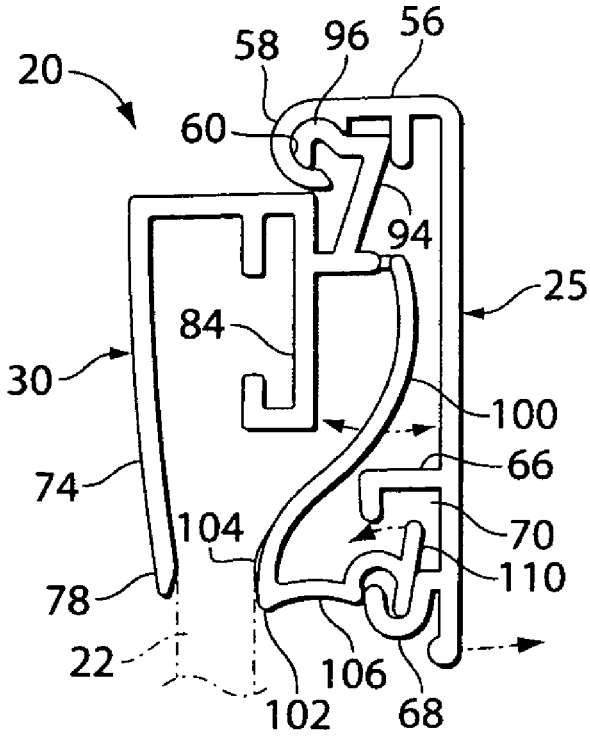
FIG. 6 is an end view of the elongated carrier frame of FIG. 3 articularbly supporting the elongated flat front plate slidably arranged thereon, which is shown in FIG. 2.
Figure 9:
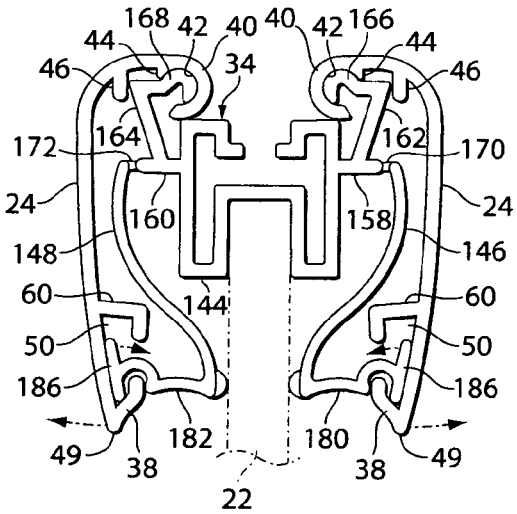
FIG. 9 is an end view of the snap frame assembly comprising the elongated H-shaped carrier frame shown in FIG. 5 in slidable combination with a pair of elongated curved front plates as represented in FIG. 1.
Figure 10:
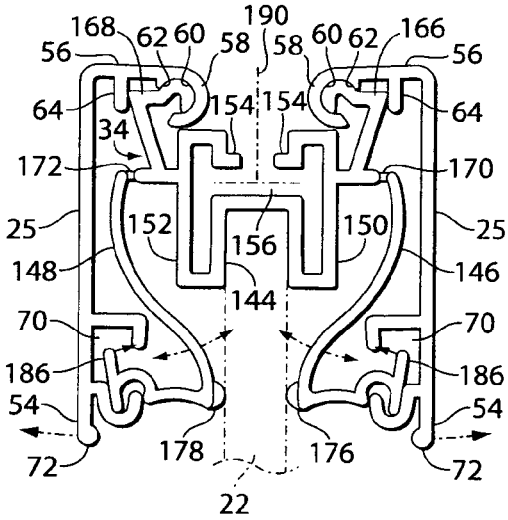
FIG. 10 is an end view of the snap frame assembly comprising the elongated H-shaped carrier frame as shown in FIG. 5 in slidable combination with a pair of elongated flat front plates as represented in FIG. 2.

Referring now to the drawings in detail, and particularly to FIG. 6, there is shown the present invention which comprises a poster/display gripping assembly 20 of elongated extruded components for gripping planar objects 22 (display panels), one sided (or two sided, as may be evidenced in FIGS. 9 and 10). One such primary component of this gripping assembly is an elongated, arcuate front plate 24, shown for example, in FIG. 1 and a flat front plate 25 in cross-section, each having a front or forward side 26 and a rearward or backside 28. The other primary component of this gripping assembly comprises an elongated carrier frame 30, 32 and 34, shown as examples in FIGS. 3, 4 and 5, respectively, on which one (or two) of the front plates 24 and/or 25 is/are mounted.

Figure 1:
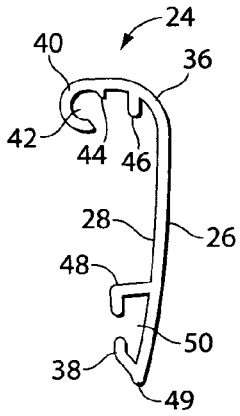
FIG. 1 is an end view of an elongated curved front plate component of the frame assembly of the present invention.

One such embodiment of this gripping assembly 20 includes the front plate 24, shown in FIG. 1, with a curved upper edge 36 and an angled lower edge 38 extending rearwardly from the front plate 24. The curved upper edge 36 has a "J"-shaped edge 40 which defines a first upper channel 42 therewithin. The J-shaped edge 40 has an elongated locking lip 44 extending parallel to the channel 42, along an inner side thereof. An elongated guide flange 46 is arranged parallel to the elongated lip 44 on the inner side of the curved upper edge of the elongated front plate 24. An elongated L-shaped finger 48 extends off the rear side of the elongated curved front plate 24, adjacent the lower edge 49 thereof. The elongated L-shaped finger 48 is spaced apart from the lower curved wall 38 on the rear side 28 of the elongated curved front plate 24 extending from the lower edge thereof. The elongated L-shaped finger 8 and the lower curved wall 38 define a foot-engaging lower channel 50 between them.

Figure 2:
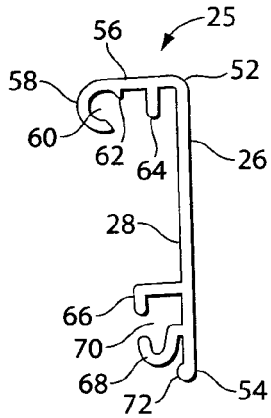
FIG. 2 is an end view of an elongated flat front plate component of the frame assembly of the present invention.

A further embodiment of the front plate component of the assembly comprises the elongated flat front plate 26 with a front side 26 and a rear or back side 28, and also having an upper edge 52 and a lower edge 54. The upper edge 52 of the elongated flat front plate 25 has an elongated wall member 56 extending rearwardly therefrom, as represented in FIG. 2. The wall member 56 is arranged perpendicularly to the elongated flat front plate 26. The elongated wall member 56 has a distal edge defined by an elongated J-shaped flange 58 which defines an elongated upper channel 60 therewithin. An elongated alignment lip 62 extends parallel to the upper channel 60 on an inner side portion of the wall member 56. An elongated slippage preventing guide wall 64 extends on an inner side of the wall member 56 in parallel relationship and spaced apart from the elongated lip 62 adjacent the J-shaped flange 58. An elongated, channel forming L-shaped finger 66 extends from the inner side of the elongated flap front plate 26 adjacent the lower edge 54 thereof. An elongated, lower channel-forming J-shaped curved wall 68 extends along the lowermost portion of the lower edge 54 of the elongated flat front plate 25 and is spaced apart from the elongated L-shaped finger 66. A foot-engaging lower channel 70 is thus defined by the space between the elongated L-shaped finger 66 and the elongated J-shaped curved wall 68 adjacent the lower edge 54 of the elongated flat front plate 25. An elongated finger manipulable bulbous edge 72 is arranged on the lowermost portion of the elongated flat front plate 25 in this embodiment.

Figure 3:
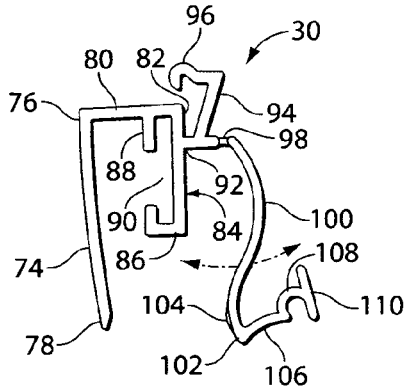
FIG. 3 is an end view of the embodiment of an elongated carrier frame having a curvilinear back plate and a single, articulable, double-curved housing plate for biased support of a front plate thereon.

A first embodiment of the elongated carrier frame 30 or internal gripping component of the compound assembly of the present invention is comprised of an elongated slightly curved backing plate 74 having an upper edge 76 and a lower edge 78, as shown in FIG. 3. An elongated bridging portion 80 extends along a forward side of the elongated upper edge 76 of the elongated backing plate 74. The elongated bridging portion 80 has an elongated forward edge 82 which comprises a portion of a front housing 84. The front housing 84 has a lower portion defined by a J-shaped lower wall 86. An elongated lip 88 extends along the inner side of the elongated bridge portion 80 to define an elongated T-shaped volume 90 between the elongated lip 88 and the J-shaped lower edge 86 of the front housing 84. An elongated support tab 92 extends forwardly from the front face of the front housing 84. An elongated arm 94 extends angularly upwardly from the upper side of the elongated tab 92, to support a commonly extruded rearwardly extending J-shaped branch 96 at a distal end thereof. The elongated tab 92 extending from a mid portion of the front housing 84 has a forward edge which defines a commonly extruded, elongated living hinge 98. The living hinge 98 is co-extruded with a double curved (somewhat sinusoidal) housing plate 100 of somewhat S-shaped in cross-sectional configuration. The upper edge of the curved housing plate 100 is co-extruded with the living hinge 98 and attached thereto to the elongated tab 92 and the front housing 84. The double curved housing plate 100 has a lower edge 102 with an elongated gripper pad 104 extending off of a lower portion facing rearwardly thereon as shown in cross section in FIG. 3. The double curved housing plate 100 has its lower edge 102 with an elongated extending leg 106 extending forwardly therefrom. The extended leg 106 has an elongated curved connection 108 thereon which is connected to an elongated planar securement foot 110 thereat. The elongated double curved housing plate 100 is arranged to be pivotable about the elongated living hinge 98.

Figure 4:
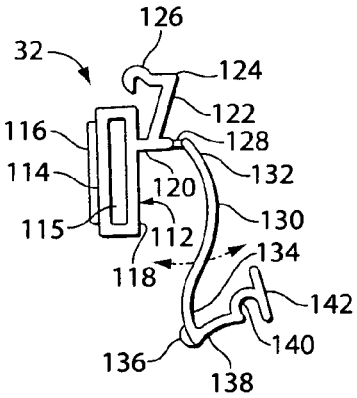
FIG. 4 is an end view of an elongated carrier frame having a generally rectangular carrier frame housing with a single, articulable double curved housing plate arranged on a front side thereof.

A further embodiment of the elongated carrier frame portion 32 of the present invention is shown in FIG. 4, which is comprised of a generally elongated, rectangularly-shaped, extruded housing 112 having a central opening or central channel 115, a backside 114 onto which a layer of adhesive material 116 may be attached. The elongated housing 112 has a front side 118 with an elongated tab 120 extending therefrom. The elongated tab 120 has an upper portion on which an elongated arm 122 is angularly arranged. The elongated angular arm 122 has an upper edge 124 with a rearwardly directed J-shaped elongated carrier branch 126 extending thereon. The elongated tab 120 has a forwardly directed distalmost edge having an elongated living hinge 128 commonly extruded therewith. A double curved housing plate 130 of generally S-shaped in cross section, has an upper end 132 which is co-extruded with the living hinge 128 co-extruded with the elongated tab 120. The double curved housing plate 130 has a lower edge 134 on which an elongated gripper pad 136 is arranged on a rearward side thereof, as may be seen in cross-section in FIG. 4. An elongated leg 138 extends forwardly from the elongated lower edge 134 of the double curved housing plate 130 and has an elongated curved connector 140 extending between the extending leg 138 and an elongated, planar securement foot 142 arranged thereon in a manner similar to the aforementioned embodiment.

A further embodiment of the generally carrier frame 34 of the present invention comprises a central, generally H-shaped double channel housing 144 arranged to support a first and a second double curved housing plate 146 and 148. The double channel housing 144 comprises a first and a second generally rectangularly shaped extrusion 150 and 152, each having a closed, spaced-apart flange 154 between which is defined the central elongated double opening or channel 156. The first (outer) side of each side of the double channel housing 150 and 152 has an elongated tab 158 and 160 extending therefrom. An elongated arm 162 and 164 extends upwardly from the respective elongated tab 158 and 160 on the first side on each side of the double channel housing 144 and an elongated J shaped, rearwardly extending carrier branch extends 166 and 168 with respect to the first and second housing portions 150 and 152 thereof. The elongated tab 158 and 160, as with the other aforementioned embodiments, each has an elongated living hinge 170 and 172 distally running therealong, which living hinges 170 and 172 are each respectively attached to an upper edge of a respective double curved housing plate 146 and 148. The first and second double curved housing plates 146 and 148 each have an elongated lower edge 174 with an arrangement of opposed elongated gripper pad 176 and 178 arranged thereon, as represented in FIG. 5, in cross-section. An extended leg 180 and 182 is arranged from the respective forward sides of the lower edge 174 of the elongated first and second double curved housing plates 146 and 148. A curved connector 184 is arranged at the forward edge of each of the respective elongated legs 184 and secures an elongated planar securement foot 186 thereon. The elongated carrier frame 34 of the present embodiment with its second double curved housing plate 148 on the opposite side thereof, comprises a mirror image of the first double curved housing plate 146 with its appropriately correspondingly directed elongated arm 164 and elongated tab 160 with its respective living hinge 172 arranged therewith.

One snap frame display assembly 20 contemplated by the present invention comprises the elongated backing plate 30 and associated elongated front housing 84 with its double curved housing plate 100 therewith, slidingly mated with the elongated flat front plate 25, as shown in FIG. 6, so as to provide a articulable biasable combination for holding a planar sheet 22 between the elongated gripper pad 104 at the lower edge 102 of the double curved housing plate 100 and the forwardly angled lower edge 78 of the backing plate 74. The elongated edge of the J-shaped branch 96 extending from the elongated arm 94 is slidably mated within the first upper channel 60 of the elongated flat front plate 25. That upper channel 60 is found within the J-shaped edge 58 on the wall member 56 extending rearwardly from that elongated flat front plate 96. The elongated planar securement foot 110 extending from the extended leg 106 of the lower edge of the double curved housing plate 100 is arranged to pivotably mate within the lower channel 70 of the elongated flat front plate 25, that lower channel 70 defined by the elongated L-shaped finger 66 and the elongated lower curved wall 68 arranged on the rear side of that flat front plate 25. Such assembly of the components is accomplished by sliding respective smaller J-shaped components 96 of the carrier frame 30 into the elongated openings created by the larger J-shaped channels 60 and the foot 110 into the lower channel 70 of the housing plate.

Figure 7:
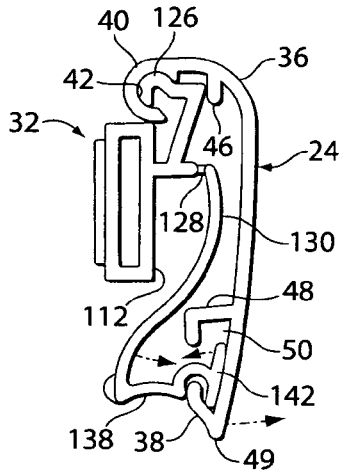
FIG. 7 is an end view of the rectangular carrier frame housing shown in FIG. 4 in slidable combination with the elongated curved front plate shown in FIG. 1.

A further combination assembly combination 32 and 24 of the present invention shown in FIG. 7 is contemplated with the generally retangularly shaped elongated housing 112 as shown in FIG. 4, having its front side thereof being slidably mated with the elongated curved front housing plate 24 identified hereinabove and shown in FIG. 1. The elongated upper channel 42 defined by the J-shaped edge 40 at the rearward side of the elongated curved upper edge 36 of the elongated curved front housing plate 24 slidably receives the elongated J-shaped distal portion 126 of the elongated carrier frame front branch 124 disposed on the elongated arm 122 on the upper side of the tab 122 on the front side of the rectangular housing 112. The elongated planar securement foot 142 extending from front side of the extended leg 138 on the lower edge 134 of the double curved housing plate 130 slidably mates with the lower channel 50 at the rearward side of the elongated curved front plate 26 which lower channel 50 is defined by the elongated L-shaped finger 48 and the elongated lower J-shaped curved wall 38, at the rearward side along the lower edge thereof as shown in FIG. 7.

Figure 8:
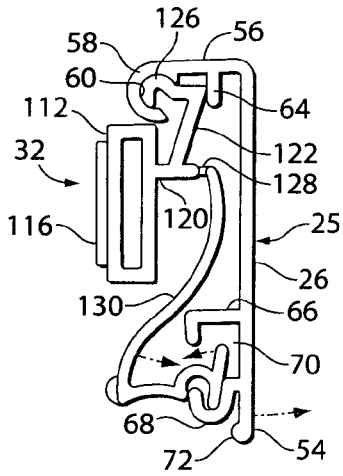
FIG. 8 is an end view of the rectangular carrier frame housing slidably shown in FIG. 4, in slidable engagement with the elongated flat front plate as shown in FIG. 2.

A further embodiment of the snap frame assembly 20 invention includes the elongated carrier frame 32 of the present invention is contemplated by the aforementioned use of the elongated retangularly-shaped, adhesively backed housing 112 shown in FIG. 4, slidably engaged with the elongated flat front plate 25, represented in FIG. 2, in combination as shown in FIG. 8, wherein the elongated carrier frame front branch 122 and its distalmost J-shaped elongated portion 126 slidably mates with the upper channel 60 within the J-shaped edge 58 of the wall member 56 of the elongated flat front plate 25. The pivotable elongated planar securement foot 142 arranged on the distal edge of the extended leg 138 on the elongated lower edge 134 of the double curved housing plate 130 is arranged so as to provide a rearwardly biasable action to the elongated gripping pad 136 arranged on the lower edge 134 of the elongated double curved housing plate 130.

A further embodiment of the snap frame assembly construction 20 of the present invention comprises the elongated carrier frame 34 of generally double channel housing 144 of H-shape in cross section, shown in FIG. 5, having its first double curved housing plate 146 and its second double curve housing plate 148 extending off in mirror image fashion from each outer side face of the double channel housing 144, each double curve housing plate slidably 146 and 148 combinably engaged, as shown in FIG. 9, with a pair of elongated curved front plates 24, originally shown in FIG. 1, being now shown as slidably received within their respective uppermost channels 42 by the J-shaped distalmost portions 166 and 168 on the elongated arms extending from the elongated tabs 158 and 160 extending from mid-portions of the double channel housing 144 with the respective elongated planar securement feet 186 arranged within the lower channels 50 of each respective double curved housing plate 24 and their respective elongated L-shaped fingers 60 and elongated lower curved walls 38 adjacent the inner directed sides along the lower edge thereof.

A still further embodiment of the snap frame assembly 20 of the present invention contemplates the elongated generally H-shaped carrier frame 34 as aforementioned here and shown by itself in FIG. 5, having a mirror image of respective first and second double curved housing plates 146 and 148 extending oppositely therefrom in sliding engagement with their respective elongated flat front plates 25 therewith, shown by itself in FIG. 2, is now shown as such a combination assembly in FIG. 10. The J-shaped distalmost portions 168 of the elongated arms 162 and 164 extending from the elongated tabs 158 and 160 on the outwardly directed sides of each first and second housing portions 150 and 152 engaging the upper channels 60 of each of the respective elongated flat front plates 25 being arranged in a mirror image of one another as shown in FIG. 10. The respective elongated planar securement feet 186 are arranged within the lower channels 70 of those elongated flat front plates 25 to provide a pinching from opposite sides thereof of any planar member 22 supported between the opposed elongated gripping pads 176 and 178 on the lowermost edge of the respective double curved housing plates 146 and 148. Such assembly 20 may also be supported by an overhead support 190 having a lower end arranged within the channels 156 within the housing 144.

Figure 11:
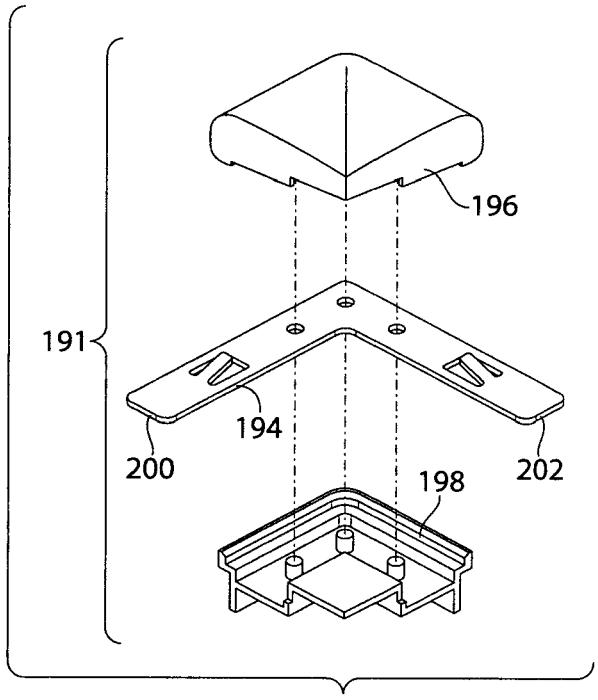
FIG. 11 is an exploded view of a corner assembly which is utilized to mate the frame assemblies together to form a corner.
Figure 12:
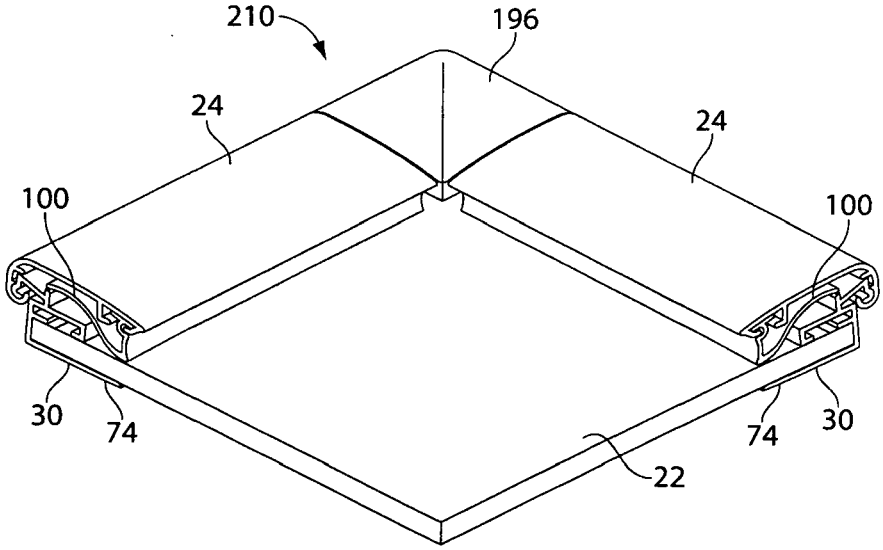
FIG. 12 is a perspective view with portions in section showing a planar display arranged with a corner assembly and a pair of adjacent adjoining elongated frame assembly portions connected to that corner assembly all of which are insertably received and biasably support a rectilinear planar display.

The frame assemblies of the aforementioned embodiments are all mateable with joinery components of corner assemblies 191, as represented in an "exploded" view in FIG. 11, to form, if desired, a rectilinear assembly as represented by a frame corner shown in FIG. 12. Those corner assemblies 191 may be comprised of a corner angle 194 with a generally square shaped corner upper cover 196, and a generally square shaped lower corner backing 198. Each corner cover 196 and backing 198 is spaced on the upper and lower sides of the corner angle 194. The extended distal portions 200 and 202 of the corner angle 194 mate with the respective central openings 90, 115 and 156, defined by the housings of the elongated carrier frames 84, 112 and 144 so as to permit the intermating of the corner angles 194 within the central openings 90, 115 and 156, thus assembling an exemplary rectangular housing display 210.

The rectangular housing display 210, a portion of which is shown in FIG. 12, may be placed with adhesive backing, against a wall structure, otr a pair of the displays 210 may be placed back-to-back, to provide a two sided display, (not shown for clarity). The corner cover 196, when placed onto adjacent curved cover plates 24, permits the display 210 to be manufactured without miter cuts on the respective ends of the plates 24, for easier assembly by the end user.

Thus there has been shown a unique combination of components for assembly a rectilinear housing for displaying a planar panel either against a wall for one sided viewing thereof, or supported from an overhead support system 190 thus permitting readily supportable and display-changeable two sided (mirror images) planar display arrangements. Such display arrangements are readily changeable and adaptable as such display arrangements require by the pivotable lifting of the lower edges 72 of either the elongated flat front plate 25 or the lowermost edge 49 of the elongated curved front plate 24 which permits the biasing and unbiasing of the articulable double curved housing plates 100, 130, 146 and 148 against such a display 22.

We claim:

1. A snap frame assembly for engagably supporting a planar display panel, comprising:

an elongated extruded carrier frame having an elongated housing with a central opening therein;

an elongated extruded front plate slidably mounted on an elongated rigid member extending from said housing and an elongated pivotable member flexibly attached to said housing by an elongated commonly extruded hinge, wherein said front plate has an upper channel member which rotatively pivots on an arm extending from said housing and a lower channel member which pivots together with a curved housing plate which comprises a portion of said housing of said carrier frame.

2. The snap frame assembly as recited in claim 1, wherein said elongated housing of said carrier frame has a pair of central openings.

3. The snap frame assembly as recited in claim 1, wherein said central openings are arranged to receive a corner angle to support a pair of assembled carrier frames and a pair of front plates.

4. The snap frame assembly as recited in claim 1, wherein said curved housing plate has a sinusoidal configuration thereto.

5. The snap frame assembly as recited in claim 4, wherein said housing plate is connected to said housing by a living hinge therebetween.

6. The snap frame assembly as recited in claim 4, wherein said curved housing plate has a lower edge with a planar foot thereon, said planar foot being pivotable in said lower channel of said cover plate.

7. The snap frame assembly as recited in claim 5, wherein said housing has an elongated strip of adhesive on a back portion thereof to permit said assembly to be attached to a wall surface.

8. The snap frame assembly as recited in claim 5, wherein said housing has a pair of spaced apart flanges which define an opening for an overhead support to enter.

9. The snap frame assembly as recited in claim 1, wherein said front plate has a lowermost edge which is spaced apart from said planar display panel to permit manual pivotable moving of said front plate away from said play panel.

10. The snap frame assembly as recited in claim 2, wherein said housing includes a pair of housing plates pivotably supported thereon.

11. The snap frame assembly as recited in claim 10, wherein said curved housing plates are pivotable independently of one another.

12. A rectilinear snap frame assembly for engagingly supporting a display panel on four sides thereof, comprising:

two parallel sets of elongated extruded carrier frames each having an elongated housing with a central opening therein, each carrier frame having a transversely shaped end at each end thereof;

an elongated extruded front plate slidably mounted on an elongated rigid member extending from each of said housings and an elongated pivotable member flexibly attached to each of said housings by an elongated commonly extruded hinge, wherein each of said front plates has an upper channel member which rotatively pivots on an arm extending from each of said housings and a lower channel member which pivots together with a curved housing plate which comprises a portion of each of said housings of each of said carrier frames; and a corner angle receiveably arranged between adjacent central openings of adjacent carrier frames; and a generally square shaped corner upper cover and a generally square shaped lower cover snap fitted over each of said corner angle to abuttingly mate respectively, with adjacent said front plates and adjacent said carrier frames.

13. The snap frame assembly as recited in claim 12, wherein each of said carrier frames is defined by a pair of elongated, spaced apart, parallel central openings.

14. The snap frame assembly as recited in claim 12, wherein each of said front plates has a transverse curve thereon.

15. The snap frame assembly as recited in claim 12, wherein each of said front plates has a flat front facia portion.

16. The snap frame assembly as reited in claim 12, wherein said display panel has a display on both sides thereof.

17. A snap frame assembly for engagably supporting a planar display panel, comprising:

an elongated extruded carrier frame having an elongated housing arrangement with a pair of elongated central openings therein;

a pair of elongated extruded front plates each slidably mounted on a respective elongated rigid member extending respectively from said housing arrangement and an elongated pivotable member flexibly attached to each said respective housing by an elongated commonly extruded hinge, wherein said front plates each have an upper channel member which rotatively pivots on a respective arm extending from said housing and each have a lower channel member which pivots together with a respective curved housing plate which comprises a portion of said respective housing of said carrier frame.

18. The snap frame assembly as recited in claim 17, wherein said planar display panel is a two sided display.

* * * * *